US005657659A

United States Patent [19]

Yamada

[11] Patent Number: 5,657,659

[45] Date of Patent: Aug. 19, 1997

[54] MANDREL MILL AND METHOD OF TUBE ROLLING BY USING THE SAME

[75] Inventor: Masayuki Yamada, Osaka, Japan

[73] Assignee: Sumitomo Metal Industries Limited, Osaka, Japan

[21] Appl. No.: 523,126

[22] Filed: Sep. 5, 1995

[30] Foreign Application Priority Data

Sep. 5, 1994 [JP] Japan ..... 6-238378

[51] Int. Cl.[6] ..... B21B 17/10

[52] U.S. Cl. ..... 72/208; 72/209; 72/224

[58] Field of Search ..... 72/208, 209, 96, 72/97, 224, 370, 235

[56] References Cited

U.S. PATENT DOCUMENTS 5,218,851 6/1993 Imae ..... 72/208
5,331,835 7/1994 Palma et al. ..... 72/224

FOREIGN PATENT DOCUMENTS 62-28011 2/1987 Japan .
6-87008 3/1994 Japan .

OTHER PUBLICATIONS

DE–FB: "Handbook des alten Huttenwesens, Walzwerkswesen", 3rd vol., 1939, Verlag Stahl und Dusseldorf, pp. 389–391.

*Revamping of Seamless Tube Plant by Mini–MPM Technology* of *Tube Economics & Technology Conference,* 10–14 May, 1993.

*Primary Examiner*—Lowell A. Larson
*Assistant Examiner*—Rodney A. Butler
*Attorney, Agent, or Firm*—Burns, Doane, Swecker & Mathis, LLP

[57] ABSTRACT

In a mandrel mill for elongating and rolling a hollow shell, with a mandrel bar inserted, by passing the hollow shell, a four-roll stand for diameter reduction used to reduce only the outer diameter of the hollow shell is disposed as the first stand, a group of two-roll stands for wall thickness reduction used to reduce the wall thickness of the hollow shell is disposed following the four-roll stand, and a four-roll stand for eccentric wall cancellation used to cancel any nonuniform wall thickness in the circumferential direction of the hollow shell is disposed as the final stand. The ratio ($D_i/D_m$) between inner diameter $D_i$ of the hollow shell on the outlet side of the four-roll stand as the first stand and outer diameter $D_m$ of the mandrel bar is 1.05 or less.

8 Claims, 3 Drawing Sheets

MANDREL MILL AND METHOD OF TUBE ROLLING BY USING THE SAME

BACKGROUND OF THE INVENTION

1. Field of the Invention

The present invention relates to a mandrel mill used to produce seamless tubes, more particularly seamless steel tubes, and a method of tube rolling by using the mandrel mill.

2. Description of Related Art

A method of using a mandrel mill is available as a method of producing seamless steel tubes. In this method, as shown in FIG. 1, after a billet 11 is heated by a heating furnace 12, it is pierced by a roughing-down mill 13 called a piercer to form a hollow shell. Next, the hollow shell is elongated and rolled by a following mandrel mill 14, and finished to a predetermined wall thickness. After reheating, the hollow shell is processed by a reducer mill 15 to a predetermined outer diameter, thereby obtaining a seamless steel tube as a product. The reheating process after elongation and rolling my be omitted sometimes.

The mandrel mill 14 has four to eight two-roll stands arranged in a row along a pass line, each stand being provided with a pair of caliber rolls. Between two stands adjacent to each other, the roll gap adjustment direction of the caliber rolls on one of the stands is set crosswise and shifted 90 degrees from the roll gap adjustment direction of the caliber rolls on the other stand in a plane perpendicular to the pass line. The hollow shell then passes between the caliber rolls of each stand, with a mandrel bar inserted therein, and is rolled in this passing process.

In the tube rolling by using such a mandrel mill, the wall thickness of the tube is finished to a predetermined dimension by rolling the material in a gap between the caliber rolls and the mandrel bar. For this reason, if the wall thickness at the finishing stand is different, the gap dimension between the caliber rolls and the mandrel bar needs to be changed accordingly. As methods of changing the gap dimension, three methods are available: replacing the mandrel bar, replacing the caliber rolls and changing the roll gap by adjusting the roll positions.

However, replacing the caliber rolls requires more effort than replacing the mandrel bar. In case the roll gap is changed by adjusting the roll positions, an eccentric wall thickness may occur in the circumferential direction of the material to be rolled. This is explained as follows. Since the wall thickness is determined by the gap determined by the caliber diameter of the caliber roll and the outer diameter of the mandrel bar, the caliber shape formed by a pair of caliber rolls is changed when the roll gap has a value other than a predetermined value, thereby changing the gap in the circumferential direction.

FIGS. 2A and 2B are schematic views showing this phenomenon by taking a truly round caliber as an example. FIG. 2A shows a state wherein the gap between a pair of caliber rolls 3', 3' and a mandrel bar 5 is uniform in the circumferential direction, namely, the wall thickness is uniform in the circumferential direction. From this state, the gap between the caliber rolls 3', 3' and the mandrel bar 5 is changed as shown in FIG. 2B. At the same time, the gap becomes nonuniform in the circumferential direction, thereby causing an eccentric wall thickness in a rolled material in the circumferential direction.

Because of these reasons, it is customary to replace the mandrel bar to change the wall thickness at the finishing stand. However, since the rolling schedule has been determined so that the wall thickness of a material to be rolled is changed in 0.5 mm increments, it is necessary to prepare mandrel bars having outer diameters in 1.0 mm increments. In addition, when rolling hollow shells having a wall thickness, about 15 mandrel bars are usually necessary, since a mandrel bar is cooled after extracted from a hollow shell and is subjected to a process wherein lubricant is applied thereto for the next rolling. For this reason, it is necessary to retain a great many mandrel bars.

To solve this problem, a four-roll stand was conceived. This stand having a combination of four caliber rolls is disposed as the final stand of the row of the stands. The roll gap adjustment direction at the stand was shifted 45 degrees from the roll gap adjustment direction at the preceding two-roll stand. The mandrel mill having the above-mentioned structure is detailed in Japanese Patent Application Mid-open No. Hei 6-87008.

With this mandrel mill, any eccentric wall thickness generated when the roll gap is changed at the row of the two-roll stands used to reduce the wall thickness is canceled by the four-roll stand as the final stand. With this feature, gap change is possible in a wider range at the row of the two-roll stands. As a result, the number of the types of mandrel bars can be decreased. The mandrel mill similar to the above-mentioned one is also described in the Japanese Patent Application Mid-open No. Sho 62-28011.

However, in case the number of caliber rolls is increased at a caliber roll stand, the width of each roll is inevitably made smaller, and a phenomenon called "squeezed outward" wherein the material is squeezed outward from between the rolls is apt to occur, Consequently, in the case of a mandrel mill provided with a four-roll stand as the final stand of the row of stands, the problem of "squeezed outward" occurs at the four-roll stand. This problem of "squeezed outward" cannot be prevented by outer diameter adjustment by using a reducer mill and muses the quality of seamless steel tubes, that is, products of the mandrel mill, to deteriorate.

Accordingly, bemuse of the secondary defect, namely, deterioration in quality, it cannot be said that the conventional mandrel mill, which is provided with a four-roll stand as the final stand of the row of stands to decrease the number of the types of mandrel bars, is satisfactory.

SUMMARY OF THE INVENTION

An object of the invention is to provide a mandrel mill which can prevent the problem of "squeezed outward" generated when a four-roll stand for eccentric wall cancellation is provided as the final stand and can economically produce high-quality seamless tubes by using a small number of mandrel bars, and a method of tube rolling which can effectively activate the mandrel mill.

When a four-roll stand for eccentric wall cancellation is provided as the final stand of the mandrel mill, the problem of "squeezed outward" occurs as described above. According to the investigations by the inventor of the invention, it was known that the problem of "squeezed outward" was significantly affected by the outer diameter of the material entering the four-roll stand. In other words, when the outer diameter of the material entering the four-roll stand is large, the problem of "squeezed outward" is apt to occur. When the outer diameter of the material is small, the problem of "squeezed outward" does not occur. For this reason, it is necessary to enter a material having a small outer diameter into the four-roll stand to prevent the problem of "squeezed outward" at the stand.

To enter a material having a small outer diameter into the four-roll stand as the final stand, a few methods can be conceived, Which reduce the outer diameter at the group of the two-roll stands disposed as stands preceding the final stand. More specifically, there are two methods: a method of adjusting the rotation speed of the rolls at each stand and a method of reducing the outer diameter of the material at the caliber rolls.

However, the method of adjusting the rotation speed of the rolls is effective only at the longitudinal central section of the material wherein tension is applied between the stands. The outer diameters at both ends cannot be reduced. In the case of the method of reducing the outer diameter at the caliber rolls, when the outer diameter of the material entering the row of the roll stands is large, the problem of "squeezed outward" occurs at the row of the stands. The outer diameter, therefore, cannot be reduced sufficiently.

For this reason, it is impossible in actuality to reduce the outer diameter at the group of the two-roll stands. Accordingly, it is necessary to reduce the outer diameter of the material entering the group of the two-roll stands, namely, it is necessary to supply a hollow shell having a small diameter to the mandrel mill. However, supplying a hollow shell having a small diameter is difficult because of another reason.

In other words, since it is necessary to insert a mandrel bar into the hollow shell before supplying the hollow shell to the mandrel mill, the inner diameter of the hollow shell must be made larger to some extent than the outer diameter of the mandrel bar. In addition, since the piercer disposed on the inlet side of the mandrel mill is a roughing-down mill, the outer diameter of the hollow shell supplied to the mandrel mill has low accuracy, and the outer diameter thereof greatly varies in the longitudinal direction and also greatly varies from one hollow shell to another. It is therefore necessary to set the outer diameter of the hollow shell to a dimension allowing the mandrel bar to be inserted into the hollow shell with a sufficient margin determined by considering the significant variations. For these reasons, it is inevitably difficult to reduce the outer diameter.

After all, under the present circumstances, it is difficult to reduce the outer diameter of the hollow shell at the two-roll stands and it is also difficult to reduce the outer diameter of the hollow shell to be supplied to the mandrel mill.

Under these circumstances, the inventor made investigations and examinations from various viewpoints to find out the method of preventing the problem of "squeezed outward" at the four-roll stand as the final stand by supplying a material having a small outer diameter to the group of the two-roll stands and by reducing the outer diameter of a material entering the four-roll stand as the final stand. As a result, forcibly reducing only the outer diameter of the hollow shell at a four-roll stand provided on the inlet side of the two-roll stands was found effective, resulting in developing the mandrel mill of the invention.

The mandrel mill of the invention is a type wherein a hollow shell with a mandrel bar inserted therein is elongated and rolled by passing the hollow shell through a plurality of caliber roll stands. In the mandrel mill, a four-roll stand for diameter reduction used to reduce only the outer diameter of the tube is disposed as the first stand of the row of stands, a group of two-roll stands for wall thickness reduction used to reduce the wall thickness of the tube are disposed following the four-roll stand, and a four-roll stand for eccentric wall cancellation used to reduce wall thickness variations in the circumferential direction is disposed as the final stand.

In the production of seamless tubes by using a mandrel mill, since the piercer is a roughing-down mill, the hollow shell produced by the piercer has low accuracy in dimension and the outer diameter of the hollow shell varies in the longitudinal direction. In particular, the outer diameter of a material having a small wall thickness after piercing is made large at the final rolling stage. In case this kind of variation in the outer diameter of the hollow shell occurs, the longitudinal dimensional accuracy of a rolled material is lowered at the next rolling machine, that is, a mandrel mill. In particular, when the number of stands in a mandrel mill is scarce, this drop in accuracy is significant. To prevent this drop in dimensional accuracy of the rolled material at the mandrel mill, there is an example wherein a four-roll stand for outer diameter adjustment is provided only on the inlet side of the two-roll stands.

In the mandrel mill of the invention, a four-roll stand for longitudinally adjusting the outer diameter of the hollow shell provided on the inlet side of the two-roll stands is utilized as a roll stand for outer diameter reduction to prevent the problem of "squeezed outward" at the four-roll stand provided on the outlet side of the two-roll stands.

Rolling for reducing only the outer diameter is defined as rolling wherein the inner and outer diameters of a hollow shell are equally reduced so that the inner surface of the hollow shell in which a mandrel bar is inserted does not closely contact the outer surface of the mandrel bar. The rolling requires a four-roll stand having a combination of four caliber rolls because of the following reasons.

It is conceivable that the number of rolls in a stand for reducing the outer diameter of the hollow shell is two, three, four or five or more. There is not any stand which has five or more rolls, since the machine including such a stand becomes complicated. In the case of a stand with three rolls, when the roll gap adjustment mechanism for driving the rolls and adjusting the outer diameter of the hollow shell is provided, the machine provided with such a mechanism becomes complicated, and the machine is not adopted. In the case of a stand with two rolls, since the reduction ratio of the average outer diameter cannot be made large, the variations in outer diameter generated at the piercer cannot be prevented. Furthermore, in the case of a stand with two rolls, since rolling is performed in two directions of the hollow shell, the hollow shell projects and moves away in the directions 90 degrees different from the roll gap adjustment direction. For this reason, the average outer diameter of the hollow shell cannot be reduced even when large rolling force is applied. Accordingly, a stand with four rolls (a four-roll stand) as the first stand is used for reducing the outer diameter of the hollow shell.

In the four-roll stands disposed as the first and final stands, each caliber roll is provided with a roll gap adjustment mechanism. In general, a pair of rolls are driven and the other pair of rolls are not driven. This is owing to the problem described below. In case all the four rolls are driven, the structure of the machine becomes very complicated and the machine cannot bear the high rolling loads of fie rolls. Only the outer diameter reduction is performed by the four-roll stand as the first stand. This is because large motor capacity is necessary and more expenses are required for the machine in case wall thickness reduction is performed additionally.

By reducing only the outer diameter by using the four-roll stand as the first stand of the row of stands, the outer diameter of the material entering the two-roll stands can be made small, even when the outer diameter of the hollow shell to be supplied to the mandrel mill is large. As a result, the outer diameter of the material entering the four-roll stand for eccentric wall cancellation is made small, without reducing the outer diameter of the material at the two-roll stands, thereby preventing the problem of "squeezed outward" at the four-roll stand.

A conventional example wherein a four-roll stand is provided as the first stand of a mandrel mill is described in "REVAMPING 0F SEAMLESS TUBE PLANT BY MINI-MPM TECHNOLOGY" of "Tube Economics & Technology" International Conference. In this conventional example, the longitudinal variations in the outer diameter of a hollow shell supplied from the roughing-down mill cannot be sufficiently compensated for only by four two-roll stands. A four-roll stand is therefore provided as the first stand of the mandrel mill in order to make the outer diameter of the hollow shell uniform and to decrease the gap between the hollow shell and the mandrel bar so that the first two-roll stand among the four stands can operate efficiently. This conventional example wherein a four-roll stand is provided only as the first stand of the row of stands fundamentally differs from the structure of the mandrel mill of the invention in regard to the fact that no four-roll stand for eccentric wall cancellation is provided as the final stand. The intention of providing a four-roll stand as the first stand also differs from that of the invention.

In the process of investigating the effectiveness of the mandrel mill of the invention, the inventor found that the ratio ($D_i/D_m$) between inner diameter $D_i$ of the hollow shell on the outlet side of the four-roll stand as the first stand and outer diameter $D_m$ of the mandrel bar exerted a significant influence on the prevention of the problem of "squeezed outward."

The method of tube rolling in accordance with the invention has been developed on the basis of this finding. When tube rolling is performed by using the mandrel mill of the invention, the ratio ($D_i/D_m$) between inner diameter $D_i$ of the hollow shell on the outlet side of the four-roll stand disposed as the first stand and outer diameter $D_m$ of the mandrel bar is set to 1.05 or less. In the method of tube rolling by using the mandrel mill of the invention, the ratio $D_i/D_m$ is important and corresponds to the degree of outer diameter reduction at the four-roll stand as the first stand. In case the ratio exceeds 1.05, it is difficult to prevent the problem of "squeezed outward" at the four-roll stand disposed as the final stand. For this reason, the ratio is set to 1.05 or less in the method of tube rolling in accordance with the invention.

The above and further objects and features of the invention will more fully be apparent from the following detailed description with accompanying drawings.

DESCRIPTION OF THE PREFERRED EMBODIMENTS

The invention will be detailed below referring to the accompanying drawing showing an embodiment thereof.

Figure 1:
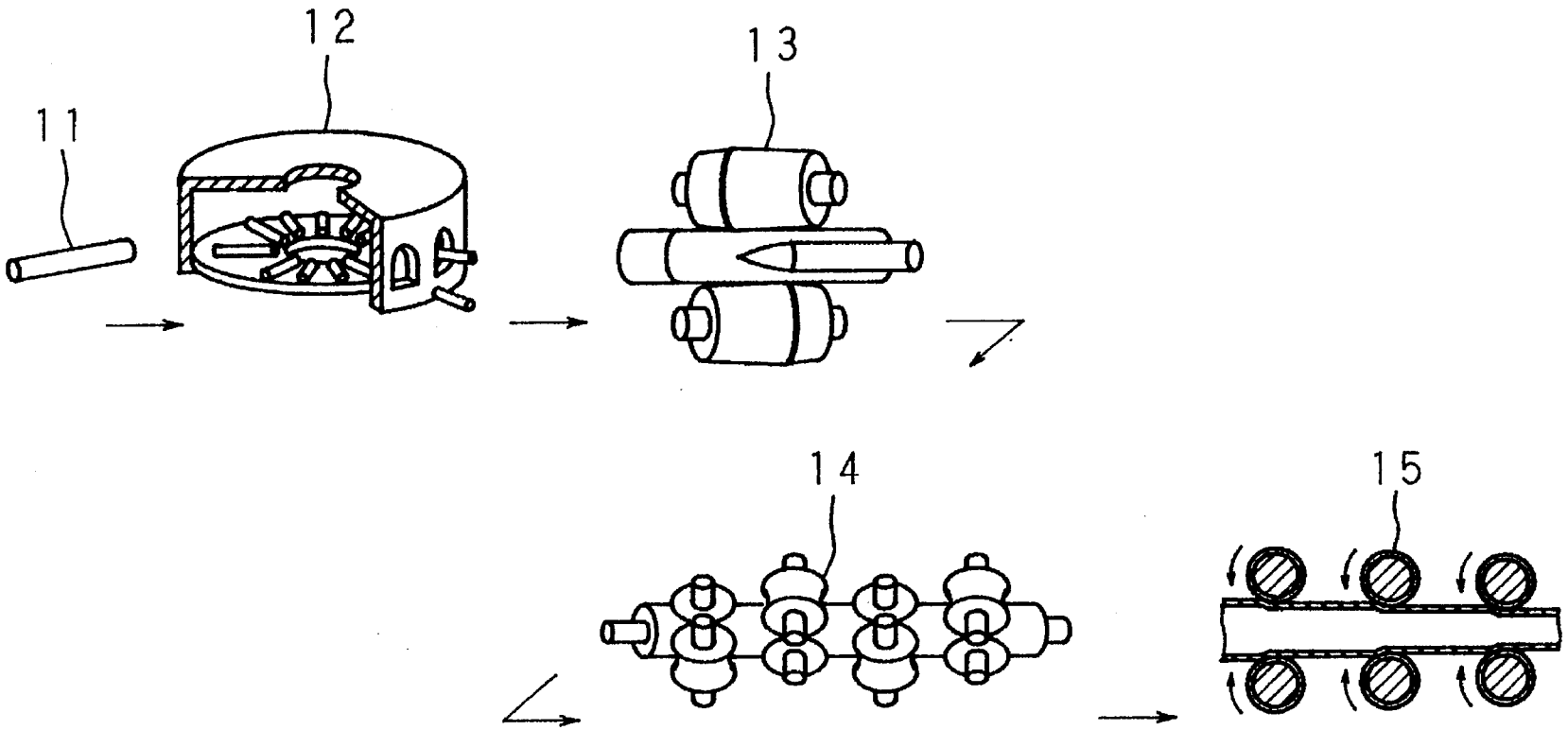
FIG. 1 PRIOR ART
FIG. 1 is a schematic perspective view of tube rolling by using a mandrel mill.
Figure 2A:
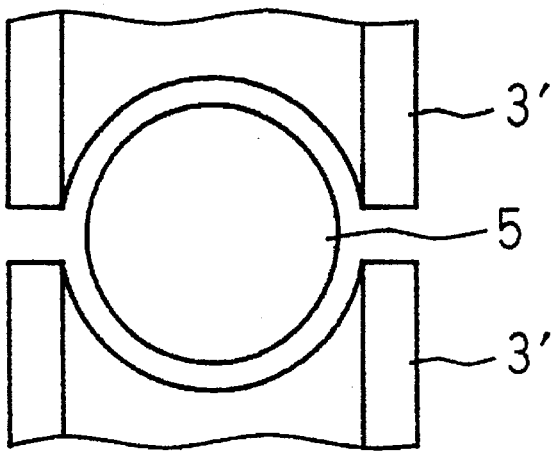
FIG. 2A PRIOR ART
FIGS. 2A and 2B schematic plane views when the roll gap is changed at a two-roll stand.
Figure 2B:
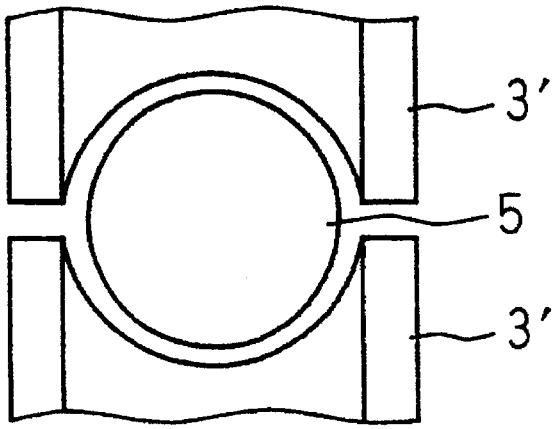
FIG. 2B PRIOR ART
Figure 3:
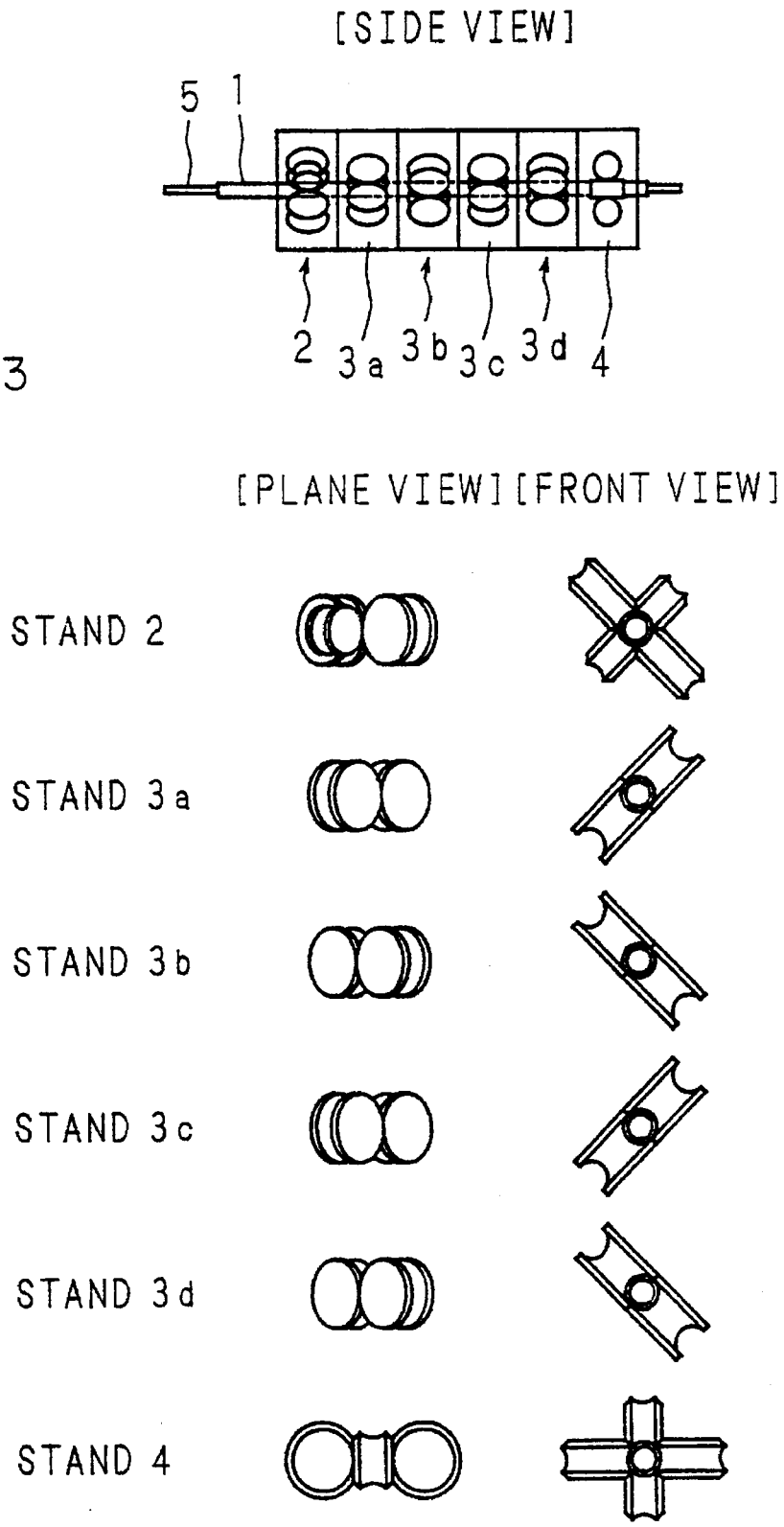
FIG. 3 is a schematic view showing the stand structure of an embodiment of the mandrel mill of the invention.

FIG. 3 shows an embodiment of the mandrel mill of the invention. A four-roll stand 2 for diameter reduction having a combination of two pairs of caliber rolls, wherein the roll gap adjustment direction of a pair is perpendicular to that of the other pair, is disposed as the first stand of the row of stands. Four two-roll stands 3*a* to 3*d* for wall thickness reduction, each provided with a pair of caliber rolls, are disposed following the four-roll stand 2. Following the two-roll stands, that is, as the final stand of the row of stands, a four-roll stand 4 for eccentric wall cancellation is disposed, which has a combination of two pairs of caliber rolls, wherein the roll gap adjustment direction of a pair is perpendicular to that of the other pair.

The roll gap adjustment direction of the four-roll stand 2 as the first stand is the same as that of the following stand, that is, the two-roll stand 3*a*. This is because it is advantageous to prevent the problem of "squeezed outward" that the material section rolled by the groove bottom section of the four-roll stand 2 as the first stand comes in contact with the flange section of the following two-roll stand 3*a*. Furthermore, in the four two-roll stands 3*a* to 3*d*, the roll gap adjustment directions of these four two-roll stands are shifted 90 degrees from one another in offer of the arrangement of the stands. The roll gap adjustment direction of the four-roll stand 4 as the final stand is shifted 45 degrees from that of the stand as the preceding stand, that is, the two-roll stand 3*d* to enhance the effect of eccentric wall cancellation.

In both the four-roll stands 2 and 4, each roll is provided with a roll gap adjustment mechanism, and a pair of rolls are driven and the other pair are not driven.

A hollow shell 1 having been produced by a piercer passes through the row of stands having the above-mentioned structure with a mandrel bar 5 inserted therein and is rolled to a seamless tube having a predetermined wall thickness.

At this time, only the outer diameter of the hollow shell 1 is reduced by the four-roll stand 2 as the first stand. The outer diameter of the material entering the two-roll stands 3*a* to 3*d* is thus reduced without taking a special process for reducing the outer diameter of the hollow shell 1 supplied to the mandrel mill. By the two-roll stands 3*a* to 3*d*, the wall thickness of the material is reduced and finished to have a predetermined dimension. By the four-roll stand 4 as the final stand, the nonuniform wall thickness in the circumferential direction generated at the two-roll stands 3*a* to 3*d* is canceled. As a result, the roll gap can be adjusted extensively at the two-roll stands 3*a* to 3*d*, thereby making it possible to produce seamless tubes having different wall thickness values by using not many kinds of mandrel bars. In addition, the outer diameter of the material entering the two-roll stands 3*a* to 3*d* is reduced and the outer diameter of the material entering the four-roll stand 4 as the final stand is also reduced accordingly, thereby preventing the problem of "squeezed outward" at the four-roll stand 4.

Although the mandrel mill shown in FIG. 3 has four stands in the group of two-roll stands, usually a mandrel mill having two to seven stands is selected.

To confirm the effects of the invention, rolling tests were conducted by using the mandrel mill (having six stands in total) shown in FIG. 3. The test results are shown in Table 1 below. In test example 1 (test results No. 1 to No. 6 in Table 1), rolling was performed by using a mandrel bar having an outer diameter of $D_m$=143 mm to produce a steel tube having rolling dimensions of 150 mm in outer diameter, 143 mm in inner diameter and 3.5 mm in wall thickness. In these conditions, the mandrel bar cannot be inserted sometimes into the hollow shell unless the difference between the inner diameter of the hollow shell and the outer diameter of the mandrel bar is 10 mm or more. The dimensions of the hollow shell were therefore set to 184 mm in outer diameter, 154 mm in inner diameter and 15 mm in wall thickness, thereby obtaining a diameter difference of 11 mm. Furthermore, in test example 2 (test results No. 7 to No. 12 in Table 1), rolling was performed using a mandrel bar having an outer diameter of $D_m$=133 mm to produce a steel tube having rolling dimensions of 150 mm in outer diameter, 133 mm in inner diameter and 8.5 mm in wall thickness. Like test example 1, in test example 2, the dimensions of the hollow shell were set to 184 mm in outer diameter, 144 mm in inner diameter and 20 mm in wall thickness so that the difference between the inner diameter of the hollow shell and the outer diameter of the mandrel bar was 10 mm or more, thereby obtaining a diameter difference of 11 mm.

TABLE 1

| No. | Rolling at first stand | Rolling at final stand | Outer diameter of tube on outlet side of first stand | Inner diameter of tube on outlet side of first stand $D_i$ | Outer diameter of mandrel bar $D_m$ | $D_i/D_m$ | Circum-stances at final stand |
|---|---|---|---|---|---|---|---|
| 1 | Not performed | Not performed | 184 mm | 154 mm | 143 mm | 1.077 | Eccentric wall |
| 2 | Not performed | Performed | 184 mm | 154 mm | 143 mm | 1.077 | Squeezing outward |
| 3 | Performed | Performed | 182 mm | 152 mm | 143 mm | 1.063 | Slight squeezed outward |
| 4 | Performed | Performed | 180 mm | 150 mm | 143 mm | 1.049 | No problem |
| 5 | Performed | Performed | 178 mm | 148 mm | 143 mm | 1.035 | No problem |
| 6 | Performed | Performed | 176 mm | 146 mm | 143 mm | 1.021 | No problem |
| 7 | Not performed | Not performed | 184 mm | 144 mm | 133 mm | 1.083 | Eccentric wall |
| 8 | Not performed | Performed | 184 mm | 144 mm | 133 mm | 1.083 | Squeezing outward |
| 9 | Performed | Performed | 182 mm | 142 mm | 133 mm | 1.068 | Slight squeezed outward |
| 10 | Performed | Performed | 180 mm | 140 mm | 133 mm | 1.053 | Slight squeezed outward |
| 11 | Performed | Performed | 178 mm | 138 mm | 133 mm | 1.038 | No problem |
| 12 | Performed | Performed | 176 mm | 136 mm | 133 mm | 1.023 | No problem |

In Nos. 1 and 7, rolling was not performed at the four-roll stand as the first stand and at the four-roll stand as the final stand. In these cases, eccentric wall thickness occurred although the problem of "squeezed outward" did not occur. In Nos. 2 and 8, rolling was not performed at the four-roll stand as the first stand. In these case, the problem of "squeezed outward" occurred at the four-roll stand as the final stand although any eccentric wall thickness was canceled by the rolling at the four-roll stand as the final stand.

Unlike these cases, in Nos. 3 and 9, the outer diameter of the hollow shell at the four-roll stand as the first stand was reduced by 2 mm. As a result, the problem of "squeezed outward" occurred slightly. In Nos. 4, 5, 6, 10, 11 and 12, the outer diameter was reduced more significantly at the four-roll stand as the first stand. In Nos. 4, 5, 6, 11 and 12 among the above-mentioned numbered cases, since the ratio ($D_i/D_m$) between inner diameter $D_i$ of the hollow shell on the outlet side of the four-roll stand as the first stand and outer diameter $D_m$ of the mandrel bar was 1.05 or less, the problem of "squeezed outward" was completely prevented at the four-roll stand as the final stand, although the outer diameter of the hollow shell was selected so that the mandrel bar was able to be inserted smoothly.

As described above, the mandrel mill of the invention can extend the gap adjustment range at the group of the two-roll stands and the number of the types of the mandrel bars can be decreased by providing a four-roll stand for eccentric wall cancellation as the final stand of the row of stands. The problem of "squeezed outward" can be prevented at the four-roll stand as the final stand by providing a four-roll stand for reducing only the outer diameter as the first stand of the row of stands. Furthermore, fie dimension of the hollow shell supplied to the mandrel mill is not required to be reduced and any secondary harmful effect, such as difficulty in insertion of the mandrel bar, is not caused. High-quality seamless tubes can therefore be produced economically by using not many types of mandrel bars, thereby being greatly effective in reducing the production cost of the tubes.

Moreover, the method of rolling tubes in accordance with the invention is significantly effective in making good use of the mandrel mill thereof and in reducing the cost for the mandrel bars and the investment cost for machines used to handle the mandrel bars and other related machines.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A mandrel mill having a row of stands comprising a plurality of caliber roll stands for elongating and rolling a hollow shell having an outer diameter and a wall thickness, with a mandrel bar inserted, by passing the hollow shell through the roll stands, comprising:

a first four-roll stand for diameter reduction disposed as a first stand of the row of the stands to reduce only the outer diameter of the hollow shell;

a second four-roll stand for eccentric wall cancellation disposed as a final stand of the row of the stands to cancel wall thickness variations in a circumferential direction of the hollow shell; and a group of two-roll stands disposed between said first four-roll stand and said second four-roll stand to reduce the wall thickness of the hollow shell.

2. A mandrel mill according to claim 1, wherein said first four-roll stand has two pairs of caliber rolls, the rolls in each pair being spaced apart by a gap that is adjustable in a roll gap adjustment direction, the roll gap adjustment direction of one pair of rolls in the first four-roll stand being perpendicular to the roll gap adjustment direction of the other pair of rolls in the first four-roll stand.

3. A mandrel mill according to claim 1, wherein said second four-roll stand has two pairs of caliber rolls, the rolls in each pair being spaced apart by a gap that is adjustable in a roll gap adjustment direction, the roll gap adjustment direction of one pair of rolls in the second four-roll stand being perpendicular to the roll gap adjustment direction of the other pair of rolls in the second four-roll stand.

4. A mandrel mill according to claim 1, wherein the group of said two-roll stands has a plurality of two-roll stands, each stand being provided with a pair of caliber rolls.

5. A mandrel mill according to claim 4, wherein the group of said two-roll stands has three to eight two-roll stands, each stand being provided with a pair of caliber rolls spaced apart by a gap that is adjustable in a roll gap adjustment direction, and the roll gap adjustment direction of each successive one of said three to eight two-roll stands being shifted 90 degrees.

6. A mandrel mill according to claim 5, wherein the roll gap adjustment direction of said second four-roll stand is shifted 45 degrees from that of the two-roll stand disposed as a final stand of the group of two-roll stands.

7. A method of tube rolling for elongating and rolling a hollow shell having an outer diameter and wall thickness, with a mandrel bar inserted, by passing the hollow shell through a mandrel mill having a plurality of caliber roll stands, comprising the following steps:

passing the hollow shell through a first four-roll stand to reduce only the outer diameter of the hollow shell;

passing the hollow shell through a group of two-roll stands to reduce the wall thickness of the hollow shell; and passing the hollow shell through a second four-roll stand to reduce wall thickness variations in a circumferential direction of the hollow shell.

8. A method of tube rolling according to claim 7, wherein the first four-roll stand possesses an outlet side, the ratio ($D_i/D_m$) between inner diameter $D_i$ of the hollow shell on the outlet side of said first four-roll stand and outer diameter $D_m$ of the mandrel bar being 1.05 or less.

* * * * *